US006585080B2

(12) United States Patent
Murray

(10) Patent No.: US 6,585,080 B2
(45) Date of Patent: Jul. 1, 2003

(54) MODULAR STANCHION HOLDER FOR REMOVABLE GUARD RAIL SYSTEM

(75) Inventor: Jeffery L. Murray, West Seneca, NY (US)

(73) Assignee: Murray Roofing Company Inc., Cheektowaga, NY (US)

( * ) Notice: Subject to any disclaimer, the term of this patent is extended or adjusted under 35 U.S.C. 154(b) by 20 days.

(21) Appl. No.: 09/947,682

(22) Filed: Sep. 6, 2001

(65) Prior Publication Data

US 2003/0042072 A1 Mar. 6, 2003

(51) Int. Cl.[7] ..... E04G 5/00

(52) U.S. Cl. ..... 182/45; 182/113; 248/231.41; 248/231.71; 256/DIG. 6

(58) Field of Search ..... 182/45, 113; 256/DIG. 6, 256/59; 248/231.41, 231.71

(56) References Cited

U.S. PATENT DOCUMENTS

| | | | | |
|---|---|---|---|---|
| 937,480 A | * | 10/1909 | Smith | |
| 3,863,900 A | | 2/1975 | Dagiel et al. | 256/59 |
| 3,995,833 A | | 12/1976 | McLaughlin et al. | 256/59 |
| 4,037,824 A | | 7/1977 | Whitmer | 256/53 |
| 4,553,872 A | * | 11/1985 | Chandra | |
| 5,029,670 A | | 7/1991 | Whitmer | 182/113 |
| D331,529 S | * | 12/1992 | Reinklou | |
| 5,353,891 A | * | 10/1994 | Griek | |
| 6,053,281 A | | 4/2000 | Murray | 182/113 |

FOREIGN PATENT DOCUMENTS

| | | | | |
|---|---|---|---|---|
| CS | 677255 | * | 4/1991 | 182/113 |
| DE | 4422406 | * | 2/1995 | 182/45 |
| GB | 2101187 | * | 1/1983 | |

* cited by examiner

*Primary Examiner*—Alvin Chin-Shue
(74) *Attorney, Agent, or Firm*—Simpson & Simpson, PLLC

(57) ABSTRACT

A stanchion holder for a rooftop safety rail system comprises a clamp having a first stanchion sleeve fixed thereto and an L-shaped adapter having a second stanchion sleeve, whereby a stanchion can be directly inserted into the first stanchion sleeve to extend in a direction orthogonal to a clamping direction of the clamp, or alternatively a male portion of the adapter can be received by the first stanchion sleeve and a stanchion can be inserted into the second stanchion sleeve to extend in a direction parallel to the clamping direction. The stanchion holder of the present invention can be installed either on a parapet or an overhanging ledge rooftop perimeter.

5 Claims, 4 Drawing Sheets

MODULAR STANCHION HOLDER FOR REMOVABLE GUARD RAIL SYSTEM

BACKGROUND OF THE INVENTION

1. Field of the Invention

The present invention relates generally to removable safety rail systems installed around rooftops to prevent workers from falling to the ground below. More particularly, the invention relates to a modular stanchion holder for such a removable guard rail system that can be mounted on either a parapet or an overhanging ledge rooftop periphery, as necessary.

2. Description of the Related Art

Construction sites are generally known to be very dangerous places. For this reason there are numerous federal and state laws that address the various health and safety issues associated with construction work and work conducted at construction sites, including rooftops and elevated areas. For instance, in the United States, Occupational Health and Safety Administration (OSHA) standards require contractors to install protective railings about a rooftop worksite according to specific guidelines. Moreover, state regulations and insurance companies mandate similar requirements. Because of this, several guardrail systems have been developed to comply with the many safety codes in existence. Among these is a safety rail system invented by the present applicant and disclosed in U.S. Pat. No. 6,053,281.

As a part of providing such a safety rail system, it is necessary to temporarily install vertical stanchions or support posts at spaced intervals around the perimeter of the work area to support the horizontal rails of the safety rail system. A variety of stanchion holders are known from safety rail systems of the prior art. For example, in the safety rail system disclosed in U.S. Pat. No. 3,863,900, each stanchion is provided with a horizontal foot that serves as a fixed jaw portion cooperating with a positionable and adjustable jaw portion to form a clamp that adjusts to clamp along a vertical clamping direction, whereby the stanchion can be clamped to an overhanging ledge. U.S. Pat. No. 3,995,833 teaches a safety rail system wherein each stanchion comprises a pair of telescopically adjustable tube segments, and each segment includes a jaw portion fixed thereto for clamping in a vertical direction to an overhanging ledge. A device for mounting a stanchion to a horizontal I-beam is described in U.S. Pat. Nos. 4,037,824 and 5,029,670, and includes a vertical stanchion-receiving sleeve fixed to a horizontal member having a fixed jaw portion and a movable jaw portion cooperating with the fixed jaw portion to clamp in a horizontal direction to a top leg of the I-beam. A safety rail system marketed by Protective Roofing Products Ltd. of Stoney Creek, Ontario, Canada, under the designation PR-100 provides a stanchion that is connectable at right angles to a mounting bracket that clamps in a horizontal direction, whereby the stanchion can be mounted to a parapet. Finally, it is known use cement anchors or other fasteners to secure a stanchion holder to a structure.

The clamping style systems of the prior art lack versatility in that they are designed to mount only to an overhanging ledge or only to a parapet. Systems requiring anchors are time-consuming and often require special tools to install.

BRIEF SUMMARY OF THE INVENTION

Therefore, it is an object of the present invention to provide a stanchion holder that can be mounted on either a parapet or an overhanging ledge of a rooftop in a fast and simple manner to enable efficient installation of a safety rail system about the rooftop perimeter.

It is another object of the present invention to provide a versatile stanchion holder that can be constructed from readily available component parts.

In view of these and other objects, a stanchion holder formed in accordance with a preferred embodiment of the present invention generally comprises a clamp having a first stanchion sleeve fixed thereto, and a right-angle stanchion sleeve adapter having a second stanchion sleeve and a male portion sized for removable receipt within the first stanchion sleeve. The first stanchion sleeve extends in a direction substantially orthogonal to a clamping direction of the clamp, such that a stanchion can be inserted vertically into the first stanchion sleeve when a horizontal clamping direction is required, as with clamping to a parapet, and the adapter is omitted. When the male portion of the stanchion sleeve adapter is received by the first stanchion sleeve, the second stanchion sleeve provided on the adapter extends in a direction substantially parallel to the direction of clamping, whereby a stanchion can be inserted vertically into the second stanchion sleeve and the clamp can be secured to an overhanging ledge by applying clamping force in a vertical direction.

The clamp itself has a C-shaped frame including a spine portion, a first leg portion fixed with respect to the spine portion, and a second leg portion opposite the first leg portion and adjustable along the spine to change its distance from the first leg portion. The first sleeve portion is fixed to and extends along the first leg portion of the clamp frame.

The male portion of the adapter and the stanchion are preferably held in place within a corresponding sleeve passage by transverse pins, however other means of releasably retaining these members are contemplated.

BRIEF DESCRIPTION OF THE DRAWINGS

The nature of the present invention will now be more fully described in the following detailed description of a preferred embodiment taken with the accompanying drawings and figures, in which.

DETAILED DESCRIPTION OF THE INVENTION

Figure 1:
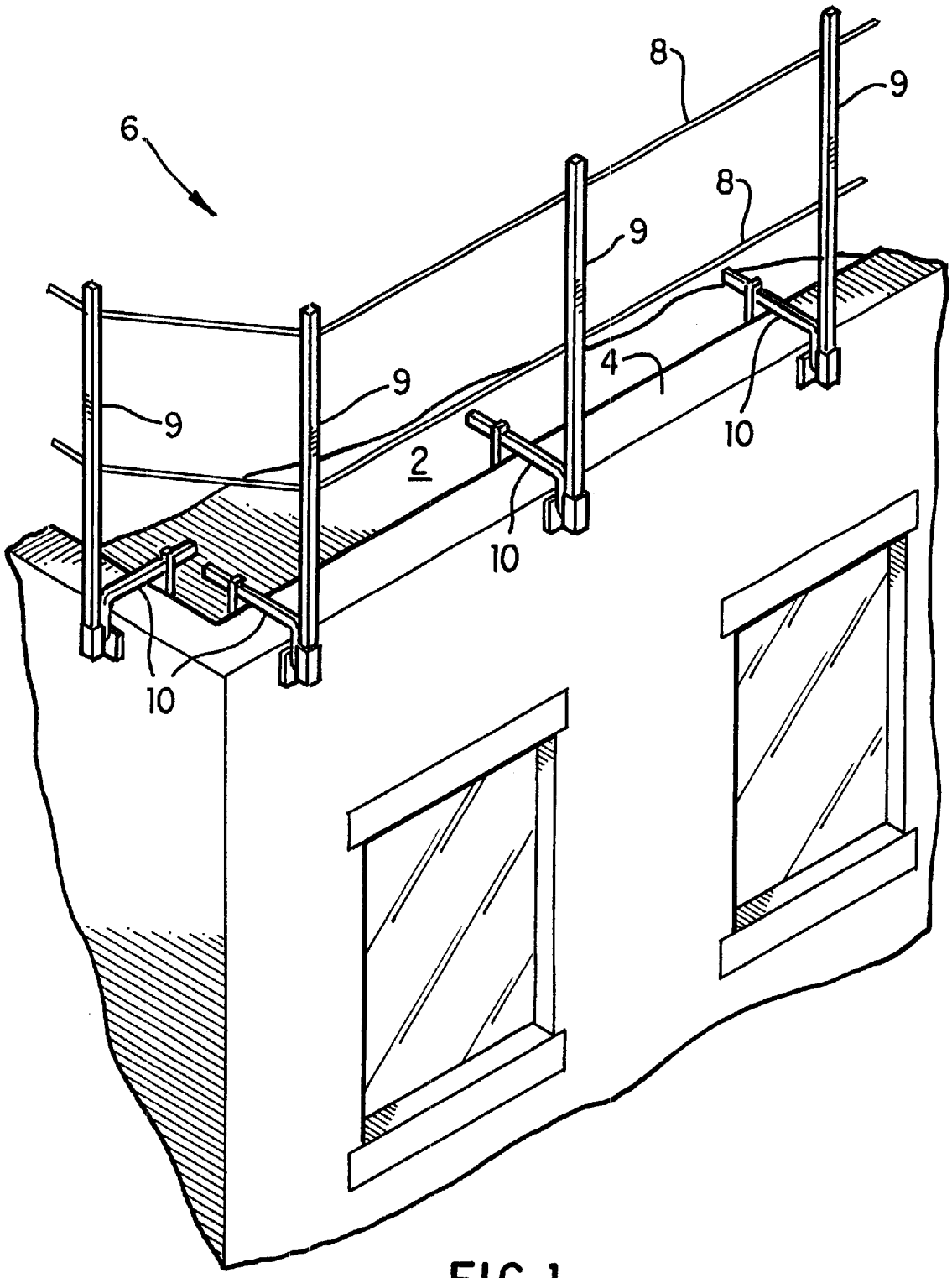
FIG. 1 is a perspective view of a safety rail system installed about a rooftop parapet using a stanchion holder formed in accordance with a preferred embodiment of the present invention.

Attention is directed initially to FIG. 1 of the drawings, which shows a safety rail system generally designated as 6 installed about a rooftop area 2 bounded by a parapet 4. Safety rail system 6 includes a pair of horizontal rails 8 supported by a plurality of vertical stanchions 9 spaced at regular intervals about rooftop area 2 and secured to parapet 9 by corresponding stanchion holders 10.

Figure 2:
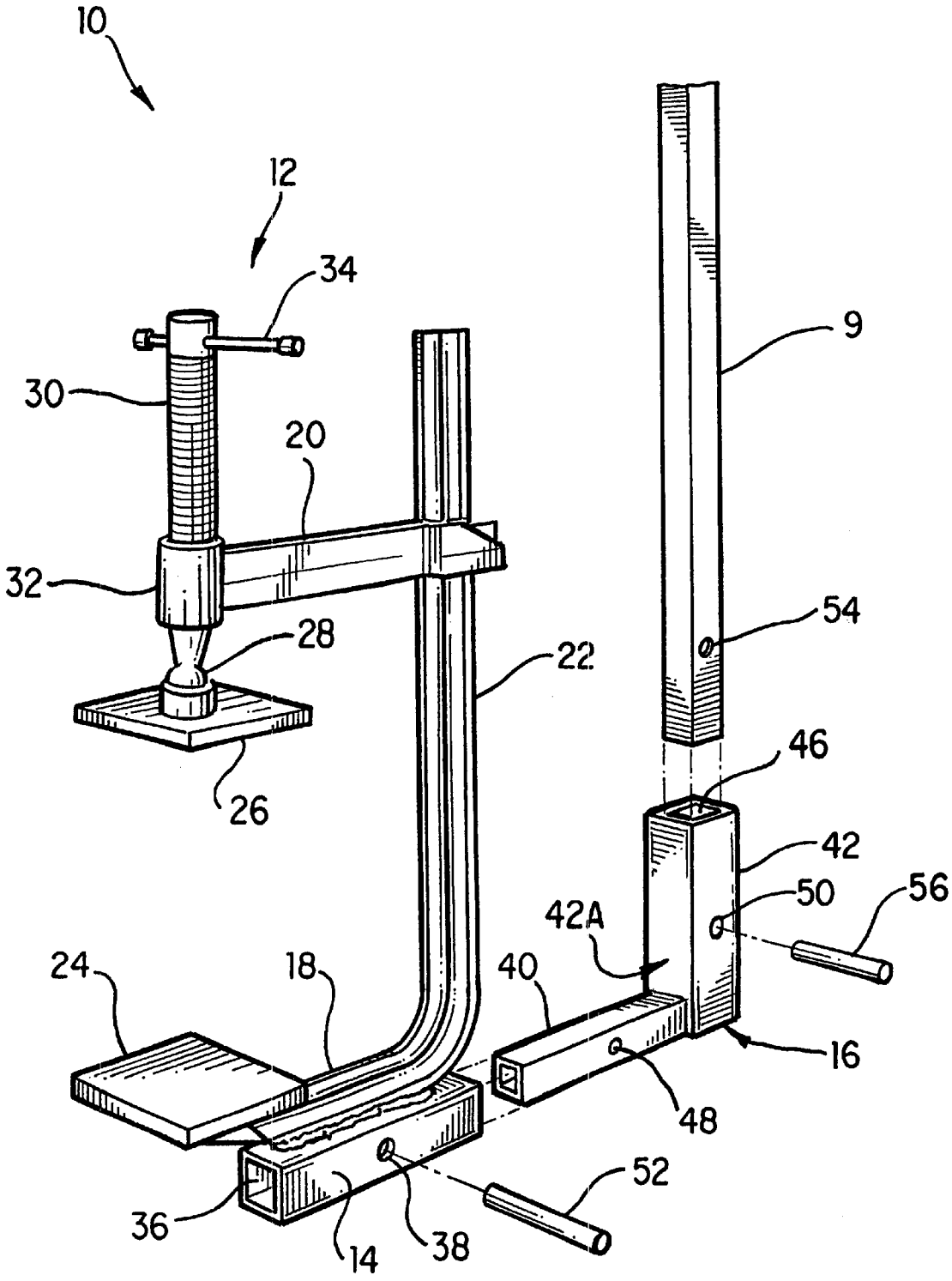
FIG. 2 is an exploded perspective view of a stanchion holder formed in accordance with a preferred embodiment of the present invention and a stanchion.

Turning now to FIG. 2, a stanchion holder 10 is shown in greater detail and comprises a clamp 12, a first stanchion sleeve 14, and a stanchion sleeve adapter 16.

Clamp 12 can be a commonly available metal clamp having a generally C-shaped frame including a first leg portion 18, a second leg portion 20 opposite first leg portion 18, and a spine portion 22 connecting the first and second leg portions. As can be seen, first leg portion 18 is integrally formed with spine portion 22, and thus is fixed relative thereto. Second leg portion 20 is connected for slidable adjustment along spine portion 22 in a manner that is well-known in the art of clamps. A fixed jaw 24 is mounted at a distal end of first leg portion 18, and an adjustable opposing jaw 26 is mounted at a distal end of second leg portion 20. More specifically, adjustable jaw 26 is mounted by a ball and socket connection 28 to a threaded adjustment rod 30 that mates with an internally threaded tube member 32 fixed to the distal end of second leg portion 20. As will be readily apparent to those skilled in the art and familiar with this type of clamp, coarse adjustments of jaw-to-jaw distance can be made by sliding second leg portion 20 along spine portion 22, while fine adjustments of jaw-to-jaw distance can be made by turning handle 34 to rotate adjustment rod 30. Clamp 12 thus defines a clamping direction between fixed jaw 24 and adjustable jaw 26 characterized by the application of clamping force along an axis parallel to the longitudinal axis of spine portion 22.

First stanchion sleeve 14 is preferably a segment of rectangular metal tubing defining a first female passage 36. Sleeve 14 is fixed by welding, using fasteners, or by other suitable means, to first leg portion 18 such that the axial direction of first female passage 36 is substantially orthogonal to the clamping direction. A transverse hole 38 is provided through the wall of first stanchion sleeve 14 at a generally intermediate location along the length of the sleeve.

Stanchion sleeve adapter 16 is L-shaped and includes a male portion 40 sized for slidable receipt within first female passage 36 of first stanchion sleeve 14. Adapter 16 further includes a second stanchion sleeve 42 defining a second female passage 46 preferably having the same cross-sectional size and shape as first female passage 36. A transverse hole 48 is provided through male portion 40 at an intermediate location along male portion 40. Likewise, a transverse hole 50 is provided through second stanchion sleeve 42 at an intermediate longitudinal location. Adapter 16 can be manufactured from two segments of different sized metal tubing by welding or otherwise fixing an end of male portion 40 to a sidewall 42A of second stanchion sleeve 42 adjacent an end thereof, with the outer dimensions of male portion 40 being chosen for close slidable fit within first female passage 36.

A retainer pin 52 preferably serves to releasably retain male portion 40 within first female passage 36 by insertion within holes 38 and 48 when these holes are aligned.

FIG. 2 further depicts a stanchion 9 of rectangular metal tubing that includes a transverse hole 54 for receiving a stanchion pin 56 as will be described below with respect to alternative installation arrangements.

Figure 3:
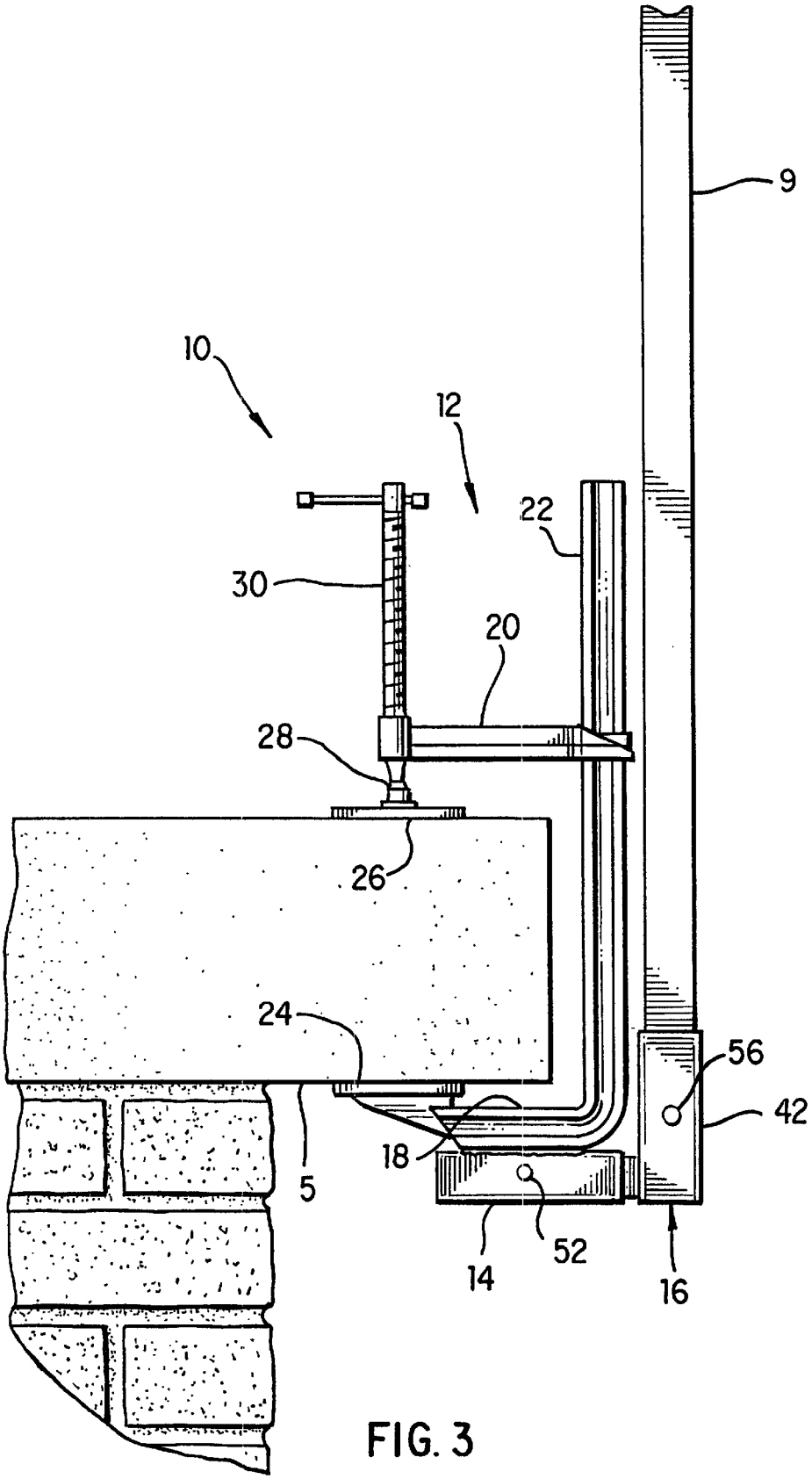
FIG. 3 is a side elevational view showing the stanchion holder of FIG. 2 installed on an overhanging ledge.

FIG. 3 shows stanchion holder 10 installed on an overhanging ledge 5 of a rooftop. Clamp 12 is arranged to clamp ledge 5 in a vertical direction, and male portion 40 of stanchion sleeve adapter 16 is secured within first female passage 36 of first stanchion sleeve 14 by retainer pin 52, such that the axis of second female passage 46 of second stanchion sleeve 42 extends in a vertical direction substantially orthogonal to the axis of first female passage 36 and parallel to the clamping direction. Stanchion 9 is slidably received within second stanchion sleeve 42 and held in place by stanchion pin 56 inserted within aligned holes 50 and 54.

Figure 4:
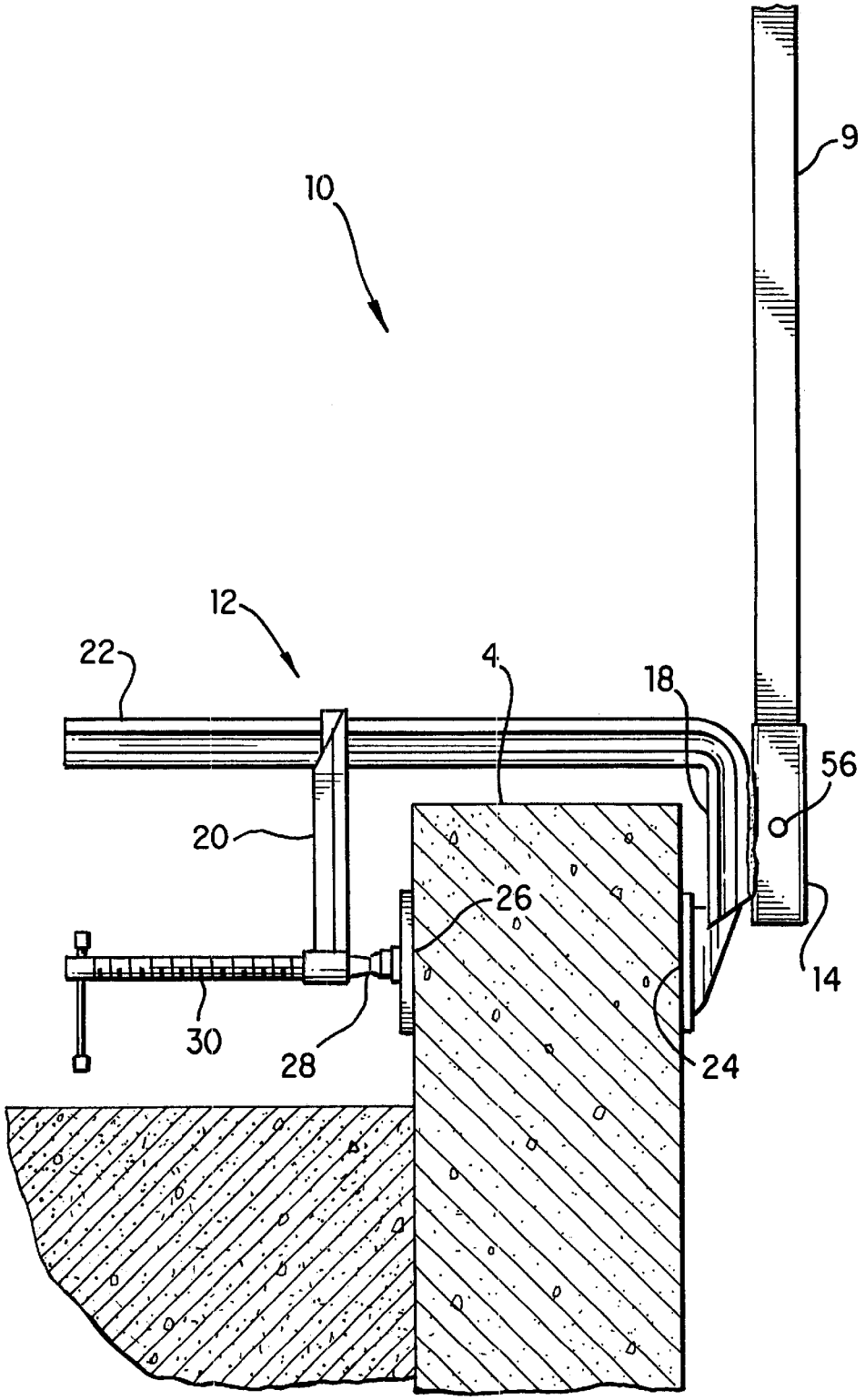
FIG. 4 is a side elevational view showing the stanchion holder of FIG. 2 installed on a parapet.

FIG. 4 illustrates stanchion holder 10 installed on parapet 4. In this installation, where the clamping direction of clamp 12 is generally horizontal, first stanchion sleeve 14 is orientated such that first female passage 36 extends in a vertical direction, and stanchion sleeve adapter is unnecessary. Accordingly, stanchion sleeve adapter 16 is removed and stanchion 9 is inserted directly into first female passage 36 of first stanchion sleeve 14 and held in place by stanchion pin 56 inserted through aligned holes 38 and 54.

It is noted that the use of pins to retain adapter 16 and stanchion 9 within a corresponding sleeve passage is subject to substitution of alternative means, including spring-loaded locking means, threaded locking means, frictional locking means, etc. It is further noted that rectangular tubing is preferred for first stanchion sleeve 14, adapter 16, and stanchion 9 because it prevents relative axial rotation between mating parts and thus allows for easier alignment of pin-receiving holes.

As will be appreciated from the foregoing description, the modular design of stanchion holder 10 enables the holder to be easily installed on either an overhanging ledge 5 or a parapet 4 without the need to change stanchions 9 or use a different holder.

What is claimed is:

1. A stanchion holder comprising:

a clamp including a first leg portion, a second leg portion and a spine; said first leg portion fixed to said spine and forming an L-shape therewith; said second leg portion adjustably connected to said spine for coarse adjustment along said spine in a clamping direction parallel to said spine;

an adjustable jaw and a fixed jaw; said adjustable jaw secured to said second leg portion and adapted for fine adjustment along said clamping direction; said fixed jaw secured to said first leg portion; said first and second jaws adapted for clamping along said clamping direction;

a first stanchion sleeve fixed to said first leg portion, said first stanchion sleeve defining a first female passage having an axis extending in a direction substantially orthogonal to said clamping direction;

an L-shaped stanchion sleeve adapter including a male portion at one end of the adapter received by said first female passage and a second stanchion sleeve fixed to said male portion at the other end of the adapter for receiving a stanchion, said second stanchion sleeve defining a second female passage having an axis extending in a direction substantially parallel to said clamping direction, said L-shaped stanchion sleeve adapter including the male portion and the second stanchion sleeve being integrally formed; and, means for releasably retaining said male portion within said first female passage.

2. The stanchion holder of claim 1 wherein said first and second female passages have the same cross-sectional size and shape.

3. The stanchion holder of claim 2 wherein said cross-sectional shape of said first and second female passages is rectangular.

4. The stanchion holder according to claim 1 wherein said means for releasably retaining said male portion within said first female passage includes a removable retainer pin arranged to extend through aligned holes in said first stanchion sleeve and said male portion.

5. The stanchion holder according to claim 1 wherein said adjustable jaw comprises a ball and socket connection.

* * * * *